US009869444B2

(12) United States Patent
Choi

(10) Patent No.: US 9,869,444 B2
(45) Date of Patent: Jan. 16, 2018

(54) FLAT LAMP STRUCTURE

(71) Applicant: Hyundai Motor Company, Seoul (KR)

(72) Inventor: Sung Uk Choi, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 138 days.

(21) Appl. No.: 14/960,161

(22) Filed: Dec. 4, 2015

(65) Prior Publication Data

US 2016/0377260 A1 Dec. 29, 2016

(30) Foreign Application Priority Data

Jun. 24, 2015 (KR) ..... 10-2015-0089433

(51) Int. Cl.
*F21V 7/00* (2006.01)
*F21S 8/10* (2006.01)

(52) U.S. Cl.
CPC ..... *F21S 48/234* (2013.01); *F21S 48/215* (2013.01)

(58) Field of Classification Search
CPC ..... F21S 48/215; F21S 48/23; F21S 48/232; F21S 48/238; F21S 48/24; F21S 48/25
See application file for complete search history.

(56) References Cited

U.S. PATENT DOCUMENTS 6,558,032 B2 * 5/2003 Kondo ..... F21S 48/1388 362/303
7,083,313 B2 * 8/2006 Smith ..... F21V 29/763 362/327
2002/0085390 A1 * 7/2002 Kiyomoto ..... B60Q 1/302 362/555
2004/0070855 A1 * 4/2004 Benitez ..... G02B 3/02 359/858
2004/0141323 A1 * 7/2004 Aynie ..... F21S 48/215 362/308
2005/0152153 A1 * 7/2005 Amano ..... F21S 48/215 362/520
2007/0133212 A1 6/2007 Lin et al.
2010/0157607 A1 6/2010 Venhaus
2015/0062943 A1 3/2015 Takahira et al.

FOREIGN PATENT DOCUMENTS

EP 1 653 149 B1 10/2011
JP 2007-149536 A 6/2007
JP 2011-253690 A 12/2011
(Continued)

*Primary Examiner* — Ali Alavi
(74) *Attorney, Agent, or Firm* — Morgan, Lewis & Bockius LLP

(57) ABSTRACT

A flat lamp structure may include a housing; a module in which at least one LED is disposed on a substrate; a reflector which reflects light emitted from the LED to the outside thereof; an inner lens which is disposed in front of the reflector with a predetermined interval to diffuse light emitted from the LED; and an outer lens which is disposed outside the inner lens and coupled to the housing, wherein the reflector has a first reflector part, a second reflector part, and a third reflector part having different optical properties and the first and second reflector parts have a specular reflection characteristic and the third reflector part has a Lambertian reflection characteristic, and reflects the light in all directions with the uniform brightness regardless of a direction to a diffuser surface to form a light emission surface.

8 Claims, 4 Drawing Sheets

(56) References Cited

FOREIGN PATENT DOCUMENTS

| | | | |
|---|---|---|---|
| JP | 2012-91673 | A | 5/2012 |
| JP | 2013-26146 | A | 2/2013 |
| JP | 2014-186827 | A | 10/2014 |
| KR | 10-2008-0073596 | A | 8/2008 |
| KR | 10-2009-0108961 | A | 10/2009 |

* cited by examiner

FLAT LAMP STRUCTURE

CROSS-REFERENCE TO RELATED APPLICATION

The present application claims priority to Korean Patent Application No. 10-2015-0089433 filed on Jun. 24, 2015, the entire contents of which is incorporated herein for all purposes by this reference.

BACKGROUND

Field of the Invention

The present disclosure relates to a flat lamp structure. More particularly, it relates to a flat lamp structure having an improved combination structure of reflectors having different optical characteristics and an inner lens so as to obtain the same surface light emitting image with a reduced number of LEDs.

Description of Related Art

Generally, since an LED has low power consumption, long life span, a small size, and a simple structure and is strong to vibration, usage of LEDs as an illumination light is significantly increased from a point of view of mass production and low cost. Further, in recent years, due to the above-mentioned advantages, usage of the LEDs as an illumination light for a vehicle is also increased.

As an example of a technology using an LED for a head lamp, a tail lamp, and a turn sign lamp, Korean Utility Model Registration No. 0380315 discloses a tail lamp for a vehicle using a light emitting diode having a structure in which large LED lamps are connected on a circuit board in series and in parallel and a plastic lens is coupled thereto on a front surface thereof.

As another example, Korean Unexamined Patent Application Publication No. 10-2006-0118950 discloses a surface style LED lamp tail light and Korean Patent Registration No. 0051883 discloses a lamp for a vehicle using a light emitting diode.

As another example, Korean Unexamined Patent Application Publication No. 10-2008-0073596 discloses, as illustrated in FIG. 1, a tail lamp for a vehicle using a light emitting diode which includes a case 11, a reflecting member 20 including reflection surfaces which are provided on the case and gradually stepped and inclined from the center in a radial direction and a retroreflection surface which reflects external light, such as light irradiated from a head lamp of a vehicle to a front surface between the reflection surfaces in a vertical direction, lamp modules 30 including a plurality of light emitting diodes 31 which are provided at a rim of the reflecting member and irradiates light to the reflection surface to be irradiated to the front surface, and a cover member 40.

However, a plurality of LEDs are used at a border of a tail lamp for a vehicle of the related art, so that manufacturing cost is increased. Therefore, structure improvement is required to achieve a necessary surface light emission effect with a reduced number of LEDs in order to reduce the manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a flat lamp structure with an improved combination structure having reflectors having different optical characteristics and an inner lens for diffusion in order to solve the problem of a flat lamp structure using an LED of the related art.

In an exemplary embodiment, a flat lamp structure includes a housing, a module in which at least one LED is disposed on a substrate, a reflector which reflects light emitted from the LEDs to the outside, an inner lens which is disposed in front of the reflector with a predetermined interval to diffuse light emitted from the LED, and an outer lens which is disposed outside the inner lens and coupled to the housing, in which the reflector has a reflector part a, a reflector part b, and a reflector part c having different optical properties and the reflector parts a and b have a specular reflection characteristic and the reflector part c has a Lambertian reflection characteristic, and reflects the light in all directions with uniform brightness regardless of a direction to a diffuser surface to form a light emission surface.

The reflector part a may be disposed to be adjacent to the LED in front of the lamp so that the light emitted from the LED may not be directly exposed to the outside but be reflected onto the reflector parts b and c.

The reflector part b may be formed to have a length which is 25 to 35% of an entire lamp length and the reflector part c may be formed to have a length which is 65 to 75% of the entire lamp length.

The reflector part a may be formed to be integrated with a connecting unit which is coupled to the lamp housing and the LED module may be mounted to be adjacent to the reflector part a in the connecting unit.

The reflector part b may be formed by depositing Al on a main body of the reflector to form a reflection layer.

The reflector part c may be formed into a main body of the reflector which is molded by white engineering plastic.

As a modification, the reflector part c may be formed by painting the surface of the main body of the reflector with white color.

In a flat lamp structure according to an exemplary embodiment of the present invention, a reflector is configured by mixing a part having a specular reflection characteristic and a part having a Lambertian reflection characteristic, so that light emitted from an LED is reflected through the part having a specular reflection characteristic and is reflected by the part having a Lambertian reflection characteristic with uniform brightness to conFIG. a flat lamp totally having uniform brightness. Therefore, even though 14 LEDs are used for a tail lamp for a vehicle having the same shape in the related art, the tail lamp for a vehicle which employs the flat lamp structure according to the exemplary embodiment of the present invention has improved reflection efficiency and obtains the same uniform brightness on the entire surface using five LEDs with the same effect as the a surface light emitting body. Therefore, without using additional parts, the number of used the LEDs is reduced, thereby reducing manufacturing cost and easily forming a package with a reduced number of the LEDs.

Other aspects and exemplary embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has at least two sources of power, for example both gasoline-powered and electric-powered vehicles.

The above and other features of the invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
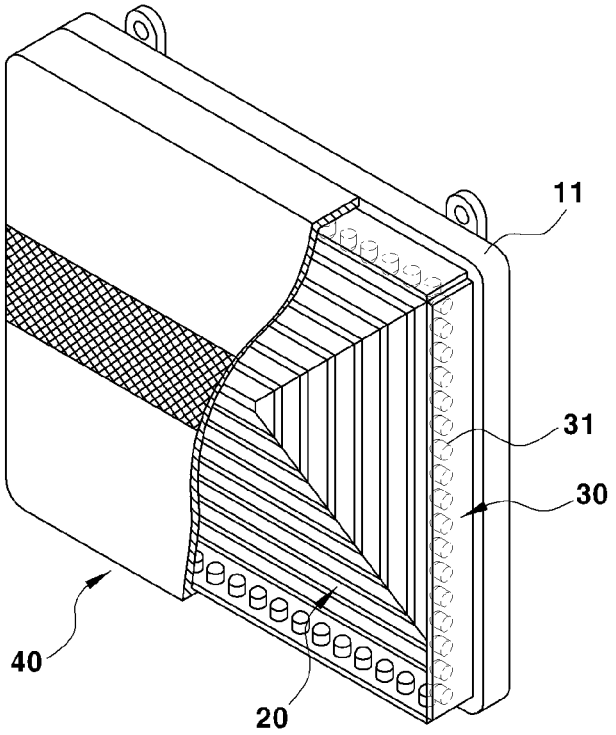
FIG. 1 is an exploded schematic perspective view illustrating a tail lamp structure for a vehicle using a light emitting diode of the related art.

Reference numerals set forth in the Drawings includes reference to the following elements as further discussed below.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, the present invention will be described in more detail with reference to the accompanying drawings which illustrate an exemplary embodiment in which a flat lamp of the present invention is applied to a tail lamp of a vehicle.

Figure 2:
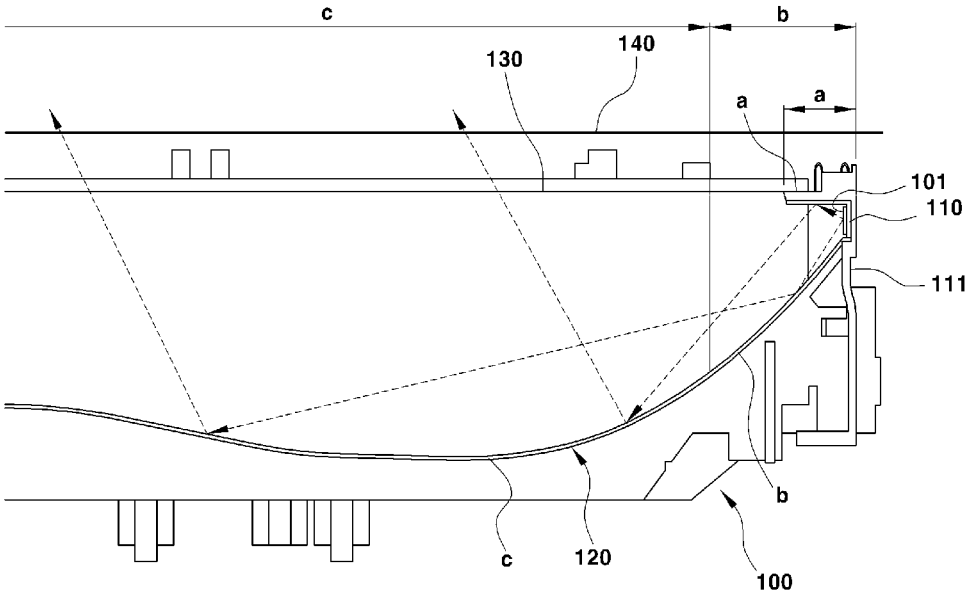
FIG. 2 is a schematic cross-sectional view of a tail lamp for a vehicle illustrating a flat lamp structure according to an exemplary embodiment of the present invention.
Figure 3:
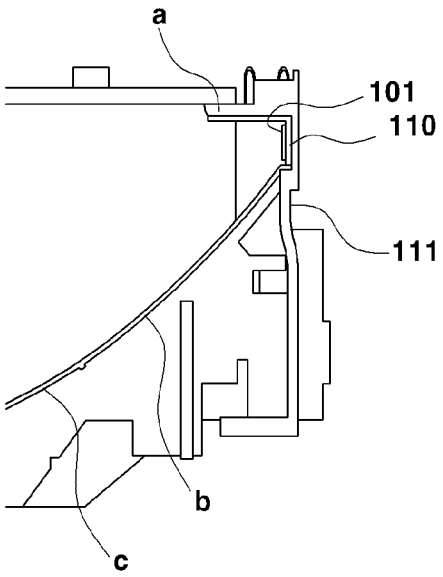
FIG. 3 is a front view of a tail lamp for a vehicle of FIG. 2.
Figure 4:
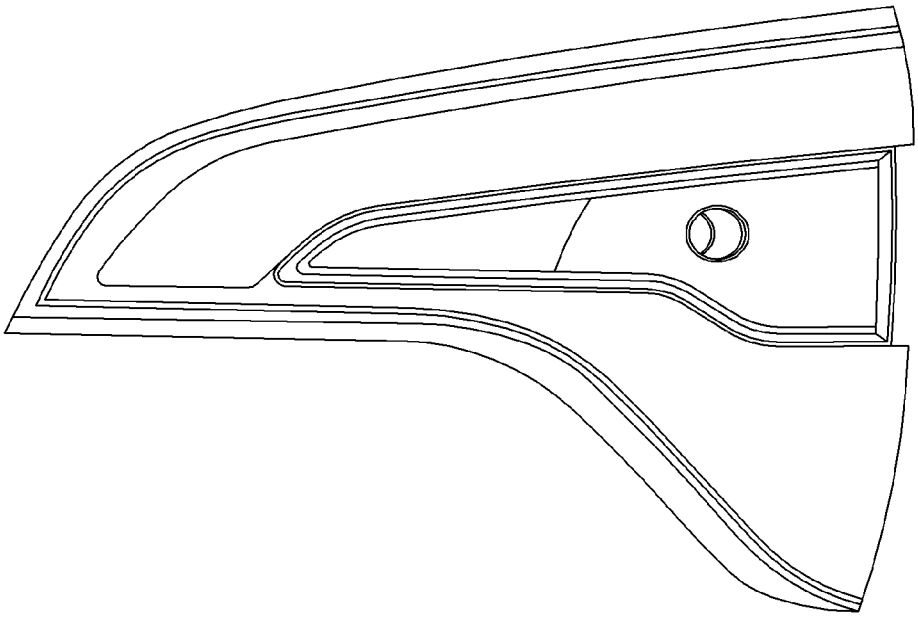
FIG. 4 is a partially enlarged view of FIG. 2.

In FIGS. 2 to 4, it is noted that the drawings illustrate an example which applies the flat lamp structure of the present invention to a tail lamp for a vehicle, but the present invention is not limited to the tail lamp for a vehicle, but may be applied to a flat lamp which may be used for various purposes.

A flat lamp as a tail lamp for a vehicle to which the present invention is applied includes a housing 100, a module 110 in which at least one LED 101 is disposed together with a heat radiating unit on a substrate, a reflector 120 in which one end is fixed to the module and the other end is fixed to the housing 100, an inner lens 130 which is disposed in front of the reflector with a predetermined interval to diffuse light emitted from the LED, and an outer lens 140 which is disposed outside the inner lens and coupled to the housing 100.

According to the exemplary embodiment of the present invention, the reflector of the flat lamp is divided into at least two parts and includes a reflector part a which has LED modules 110 mounted at a front side of the lamp and is disposed to be adjacent to the LED 101 toward a front side of the flat lamp, a reflector part b which is disposed to be adjacent to the LED 101 toward a rear side of the flat lamp, and a reflector part c which is disposed to extend in a direction which is distant from an end of an opposite side to an LED of the reflector part b. A length of the reflector part b mentioned below includes a length of the reflector part a. Lengths of the reflector parts a, b, and c are illustrated at an upper part of FIG. 2.

The reflector part a is formed to be integrated with a connecting unit 111 which is coupled to the lamp housing, and the LED module 110 is mounted to be adjacent to the reflector part a in the connecting unit. The reflector part a is disposed in front of the lamp so as to be adjacent to the LED to prevent the light which is directed to the front side of the lamp from the LED from being directly exposed but to reflect the light toward the reflector parts b and c.

As seen from the front of the lamp, the reflector part b is formed to have approximately a third of a horizontal length of the entire lamp from the front of the lamp and desirably approximately 25 to 35% of the horizontal length of the entire lamp, and the reflector part c is formed to have an approximately ⅔ of the horizontal length of the entire lamp, and desirably 65 to 75% thereof.

The reflector parts of the flat lamp according to the exemplary embodiment of the present invention have three different optical characteristics. That is, parts a and b of the reflector 120 are formed to have a specular reflection characteristic and the reflector part c is formed to have a Lambertian reflection characteristic.

The specular reflection characteristic and the Lambertian reflection characteristic are known. The reflector of a lamp for a vehicle of the related art may have the specular reflection characteristic in order to obtain a lamp light distribution characteristic which is required by a regulation of a vehicle, and the Lambertian reflection characteristic is mainly used for a monitor.

As described in an exemplary embodiment of the present invention, a combination structure in which the specular reflection characteristic in the reflector parts a and b is applied to reflect light emitted from the LED to an entire region of the reflector and the Lambertian reflection characteristic in the reflector part c is applied to obtain surface light emission effect with totally uniform brightness is not disclosed in the related art.

The reflector parts a and b may be formed by depositing Al on a main body of the reflector to form a reflection layer to have at least 85% of reflectance, for obtaining the specular reflection characteristic. Further, in order to obtain the Lambertian reflection characteristic, the reflector part c may be formed by painting a surface of the main body by white color or molding the main body by a white engineering plastic.

Therefore, the reflector part a having a specular reflection characteristic reflects the light like a mirror without affecting a property of light emitted from the LED to mainly transmit the light emitted from the LED toward the reflector parts b and c.

In the meantime, a Lambertian reflection surface is also referred to as a complete diffuser surface and means a surface in which a reflective luminous intensity is constant regardless of a watching angle, as a reflector having a uniform speed of light in all directions at a unit solid angle in which an intensity of reflected light in accordance with an angle of a surface of an object varies as a cosine function of an angle between a normal line and a direction of the reflected light. An example of the Lambertian reflection surface is full moon or a white paper which is close to a complete diffuser surface.

In the exemplary embodiment of the present invention, the Lambertian reflection characteristic of the reflector part c mean that the reflector part c has a characteristic as a Lambertian reflection surface.

Therefore, the reflector part c having the Lambertian reflection characteristic configures an emission surface which reflects light reflected by the reflector part b with the same brightness in all direction regardless of a direction to the diffuser surface, for example, as if the white paper is seen.

The inner lens may be formed of a light diffusing PC material as usual.

Al deposition is performed, like the reflector part b, in inner surfaces of protruding front side part and rear side part of the Led module 110 so as to have a specular reflection characteristic.

Figure 5:
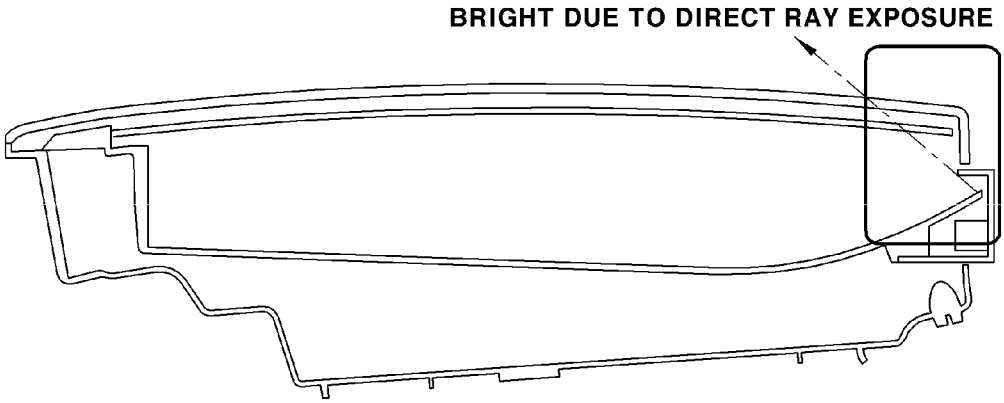
FIG. 5 and FIG. 6 are views explaining problems of a part of an LED which is exposed by direct ray in accordance with a length of a reflector part a in a flat lamp structure of FIG. 2.
Figure 6:
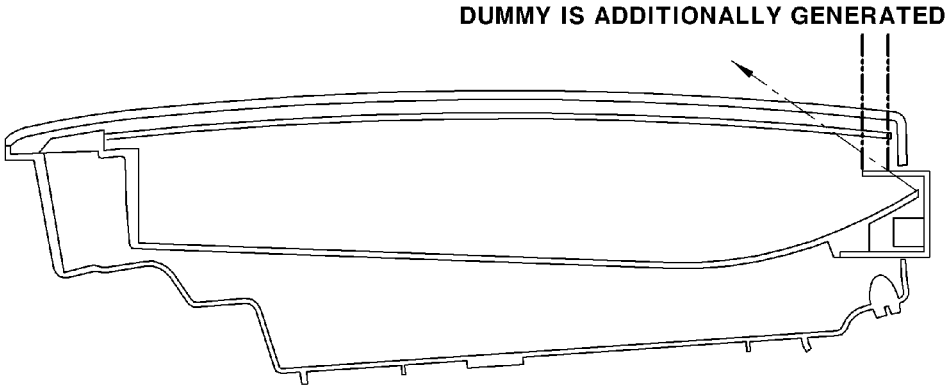

In FIGS. 5 and 6, when a part where a direct ray of an LED is exposed through an outer lens in the flat lamp according to the exemplary embodiment of the present invention, that is, a length of the reflector part a is shorter than a predetermined value which is set in advance in accordance with a size of the lamp (see FIG. 5), the light emitted from the LED is directly out through an outer lens so that uniformity of the brightness may not be achieved. When the reflector part a is longer than a predetermined value (see FIG. 6), a part where the light emitted from the LED is blocked is increased, so that the emission surface is reduced, thereby lowering a quality of an exterior image.

Figure 7:
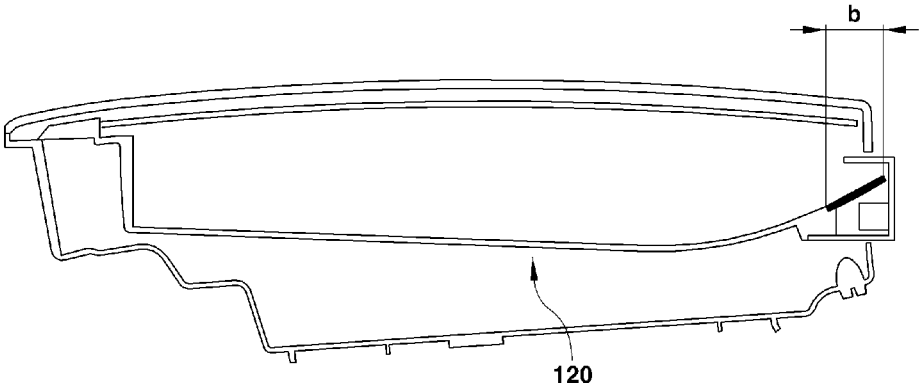
FIGS. 7 and 8 are views explaining problems of a reflection characteristic when a length of a reflector part (b) is too short or long in the flat lamp structure of FIG. 2.
Figure 8:
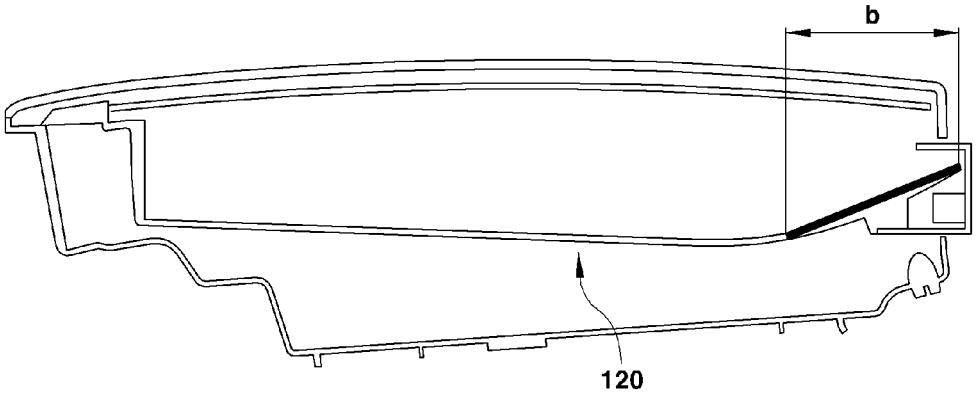

In FIGS. 7 and 8, when a length of the reflector part b in the flat lamp according to the exemplary embodiment of the present invention is shorter than a predetermined length (see FIG. 7), a length by which light reflected from the reflector part b is transmitted to the Lambertian reflector is small so that a dark zone is generated at an end. When the length of the reflector part b is longer than a predetermined length (see FIG. 8), a light amount by the specular reflection surface is excessive so that a light entering unit is relatively bright.

As described above, it is confirmed that when a flat lamp structure according to the exemplary embodiment of the present invention is applied to a tail lamp for a vehicle so that an LED emits light, an improved reflection efficiency is obtained and the same effect as a surface light emitting body is obtained on an entire surface with uniform brightness. Therefore, it is confirmed that even though 14 LEDs are used for a tail light for a vehicle having the same shape in the related art, five LEDs are used for the tail lamp for a vehicle which employs the flat lamp structure according to an exemplary embodiment of the present invention to obtain the same brightness. According to the flat lamp of the present invention, the number of used LEDs is reduced without having a separate additional part, thereby reducing manufacturing cost and easily forming a package.

The flat lamp structure for a vehicle according to an exemplary embodiment of the present invention may be used for a flat lamp in various fields including interior in addition to the tail lamp for a vehicle.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A flat lamp structure, comprising:

a housing;

a module in which at least one LED is disposed on a substrate;

a reflector which reflects light emitted from the LED to the outside thereof;

an inner lens which is disposed in front of the reflector with a predetermined interval to diffuse light emitted from the LED; and an outer lens which is disposed outside the inner lens and coupled to the housing, wherein the reflector has a first reflector part, a second reflector part, and a third reflector part having different optical properties and the first and second reflector parts have a specular reflection characteristic and the third reflector part has a Lambertian reflection characteristic, and reflects the light in all directions with the uniform brightness regardless of a direction to a diffuser surface to form a light emission surface.

2. The flat lamp structure of claim 1, wherein the first reflector part is disposed to be adjacent to the LED in front of the lamp so that the light emitted from the LED is not directly exposed to the outside but is reflected onto the second and third reflector parts.

3. The flat lamp structure of claim 1, wherein the second reflector part is formed to have a length which is 25 to 35% of an entire lamp length and the third reflector part is formed to have a length which is 65 to 75% of the entire lamp length.

4. The flat lamp structure of claim 1, wherein the first and second reflector parts are formed by depositing Al on a main body of the reflector to form a reflection layer.

5. The flat lamp structure of claim 1, wherein the first reflector part is formed to be integrated with a connecting unit which is coupled to the lamp housing and the LED module is mounted to be adjacent to the first reflector part in the connecting unit.

6. The flat lamp structure of claim 1, wherein the third reflector part is formed by paining a surface of the main body of the reflector with white color.

7. The flat lamp structure of claim 1, wherein the third reflector part is formed into a main body of the reflector which is molded by a white engineering plastic.

8. The flat lamp structure of claim 1, wherein a heat radiating unit is disposed on the substrate together with the module.

* * * * *